US006419877B1

(12) United States Patent
Elgelid et al.

(10) Patent No.: US 6,419,877 B1
(45) Date of Patent: Jul. 16, 2002

(54) COMPRESSED SOFT MAGNETIC MATERIALS

(75) Inventors: Cecilia Elgelid; Anne Larsson-Westberg, both of Helsingborg; Lars-Åke Larsson, Höganäs, all of (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/802,848

(22) Filed: Mar. 12, 2001

(30) Foreign Application Priority Data

Jan. 26, 2001 (SE) ..... 0100236

(51) Int. Cl.[7] ..... B22F 1/02
(52) U.S. Cl. ..... 419/35; 419/26; 419/29
(58) Field of Search ..... 419/26, 29, 35

(56) References Cited

U.S. PATENT DOCUMENTS

| | | | |
|---|---|---|---|
| 3,245,841 | A | 4/1966 | Clark et al. |
| 3,837,912 | A | 9/1974 | Roden |
| 4,360,377 | A | 11/1982 | Steck et al. |
| 4,602,957 | A | 7/1986 | Pollock et al. |
| 5,798,177 | A | 8/1998 | Jansson et al. |

FOREIGN PATENT DOCUMENTS

| | | | |
|---|---|---|---|
| DE | 3439397 | A1 | 4/1986 |
| EP | 0 179 557 | A2 | 4/1986 |
| JP | 132109 | | 5/1994 |
| WO | WO 99/30901 | A1 | 6/1999 |

*Primary Examiner*—Ngoclan Mai
(74) *Attorney, Agent, or Firm*—Burns, Doane, Swecker & Mathis, LLP

(57) ABSTRACT

The invention concerns a process for the preparation of a compressed soft magnetic powder core comprising the steps of compacting an iron based powder the particles of which are insulated by a chromium containing layer, at a pressure between 300 and 1500 Mpa. The compacted body is then heated to a temperature sufficient for achieving stress relief and recrystallization of the iron base material.

20 Claims, 3 Drawing Sheets

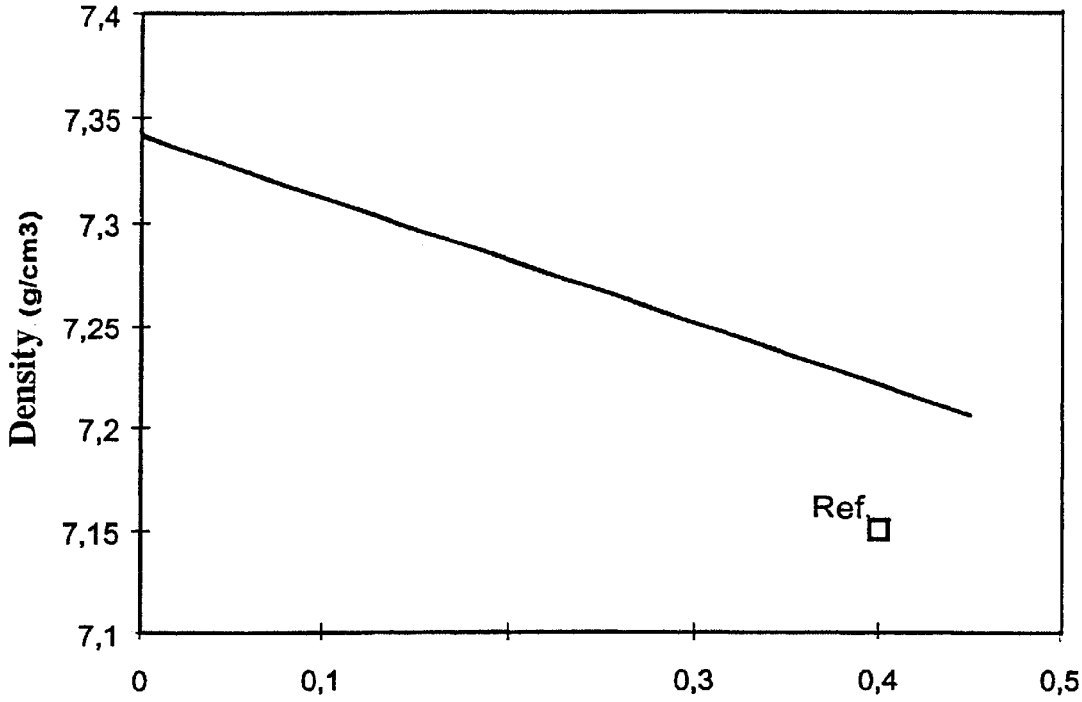
Figure 1
Figure 2
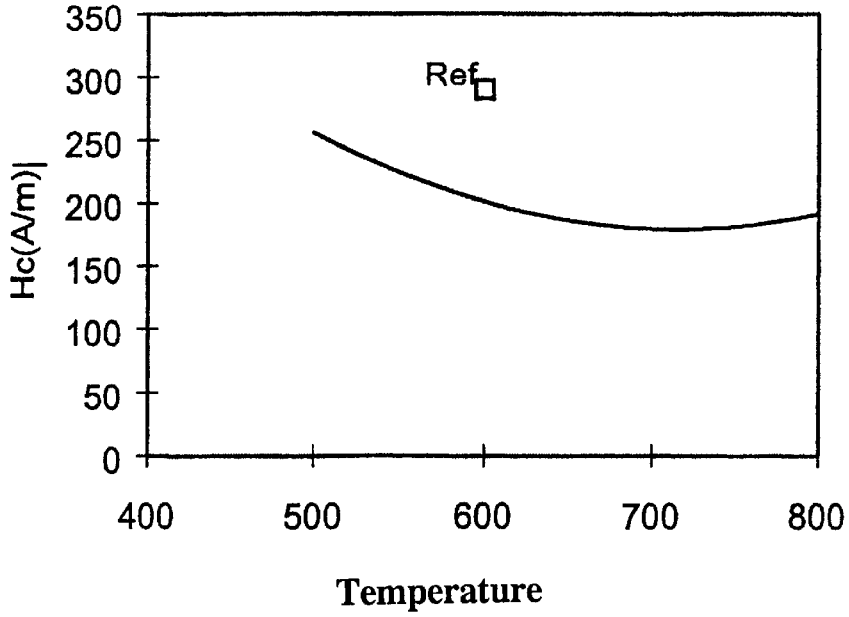

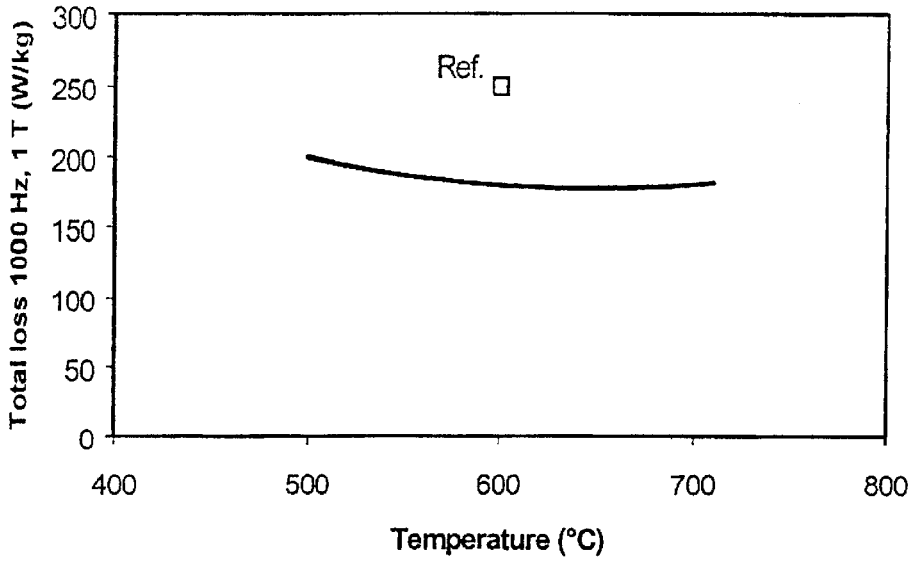
Figure 3
Figure 4
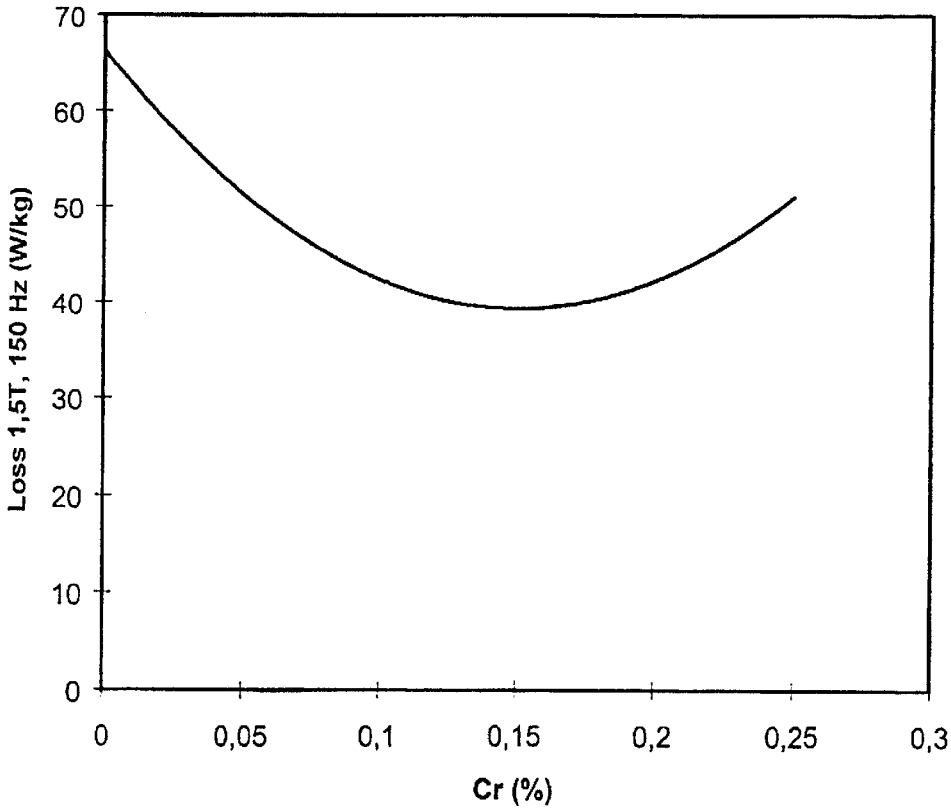

COMPRESSED SOFT MAGNETIC MATERIALS

FIELD OF INVENTION

This invention relates to soft magnetic materials. More particularly, the invention relates to a method in which iron powders are pressed and subsequently heat treated. The method is particularly useful to make magnetic core components having improved soft magnetic properties.

BACKGROUND OF INVENTION

Iron-based particles have long been used as a base material in the manufacture of structural components by powder metallurgical methods. The iron-based particles are first moulded in a die under high pressures in order to produce the desired shape. After the moulding step, the structural component usually undergoes a sintering step to impart the necessary strength to the component.

Magnetic core components have also been manufactured by such power metallurgical methods, but the iron-based particles used in these methods are generally coated with a circumferential layer of insulating material.

Two key characteristics of an iron core component are its magnetic permeability and core loss characteristics. The magnetic permeability of a material is an indication of its ability to become magnetized or its ability to carry a magnetic flux. Permeability is defined as the ratio of the induced magnetic flux to the magnetising force or field intensity. When a magnetic material is exposed to a rapidly varying field, the total energy of the core is reduced by the occurrence of hysteresis losses and/or eddy current losses. The hysteresis loss is brought about by the necessary expenditure of energy to overcome the retained magnetic forces within the iron core component. The eddy current loss is brought about by the production of electric currents in the iron core component due to the changing flux caused by alternating current (AC) conditions.

Magnetic core components are made from laminated sheet steel, but these components are difficult to manufacture to net shape for small intricate parts and experience large core losses at higher frequencies. Application of these lamination-based cores is also limited by the necessity to carry magnetic flux only in the plane of the sheet. Sintered metal powders have been used to replace the laminated steel as the material for the magnetic core component, but these sintered parts also have high core losses and are restricted primarily to direct current (DC) operations.

Research in the powder metallurgical manufacture of magnetic core components using iron-based powders has been directed to the development of iron powder compositions that enhance certain physical and magnetic properties without detrimentally affecting other properties. Desired properties include low core losses, a high permeability through an extended frequency range, high pressed strength, and suitability for compression moulding techniques.

In order to decrease losses in a core component for AC power applications it is generally required that the particles have an electrically insulating coating or layer which prevents contact between the particles. An important feature of this layer is its ability to withstand high temperatures without degrading as it is generally desired to heat treat compacted bodies prepared from the powders in order to achieve stress relief. Particularly interesting are insulating layers that can resist temperatures above the recrystallisation temperature of the base material, ie the non insulated powder, without degrading the insulation as important changes to the properties of the base powder occur after the recrystallisation. Another requirement is that the coating should influence the density of a compacted product prepared therefrom to smallest possible extent.

Insulating coatings are described in e.g. U.S. Pat. No. 5,798,177 and DE 34 39 397. According to these publications the coatings are obtained by treating iron based powders with coating solutions including phosphoric acid. The compacted product prepared from the insulated powders is subsequently heat treated.

U.S. Pat. No. 3,245,841 discloses the production of a magnetic powder having high electrical resistance. The powder is prepared by treating an iron powder with a coating solution including phosphoric acid and chromic acid. Compressed powder cores prepared from such a powder are suitable for use in high frequency power devices. The patent is silent about the possibilities to heat treat products prepared from the powders.

Another type of coating is disclosed in U.S. Pat. No. 4,602,957. According to this patent a magnetic powder core, suitable for use in a low frequency power device, is prepared by treating an iron powder with an aqueous solution of potassium dichromate, drying the powder, compressing the powder to form a compact and heat treating the compact at substantially 600° C.

However to the best of our knowledge the insulated powders prepared as described in these publications do not combine the properties of high thermal resistance with high compressibility.

OBJECTS OF THE INVENTION

One object is to provide compressed materials, which are distinguished by good soft magnetic properties, such as low total loss, high permeability, low coercivity, good frequency stability etc.

A second object is to provide soft magnetic materials which can withstand temperatures at and above the recrystallisation temperature of the iron base material without the insulating layer surrounding the iron base particles being degraded.

A third object is to provide a powder, which may be compacted to high densities in a single compacting step.

A fourth object is to provide a soft magnetic material useful for AC power applications at low and moderate frequencies.

SUMMARY OF THE INVENTION

According to the present invention the above objects may be obtained by a process comprising the following steps compacting an iron based powder, the particles of which are insulated by a chromium containing layer at a pressure between 300 and 1500 MPa; and heating the compacted body to a temperature sufficient for achieving stress relief and recrystallisation of the iron based material.

BRIEF DESCRIPTION OF THE DRAWINGS

FIG. 1 illustrates the relationship between density and chromium content of compacted insulated powder according to the invention.

FIG. 2 illustrates the relationship between coercivity and temperature for toroids prepared in Example 1 according to the invention.

FIG. 3 illustrates the relationship between total loss and temperature for toroids prepared in Example 1 according to the invention.

FIG. 4 illustrates the relationship between total loss and chromium content for toroids prepared in Example 2 according to the invention.

DETAILED DESCRIPTION OF THE INVENTION

The Iron Based Powder

Figure 5:
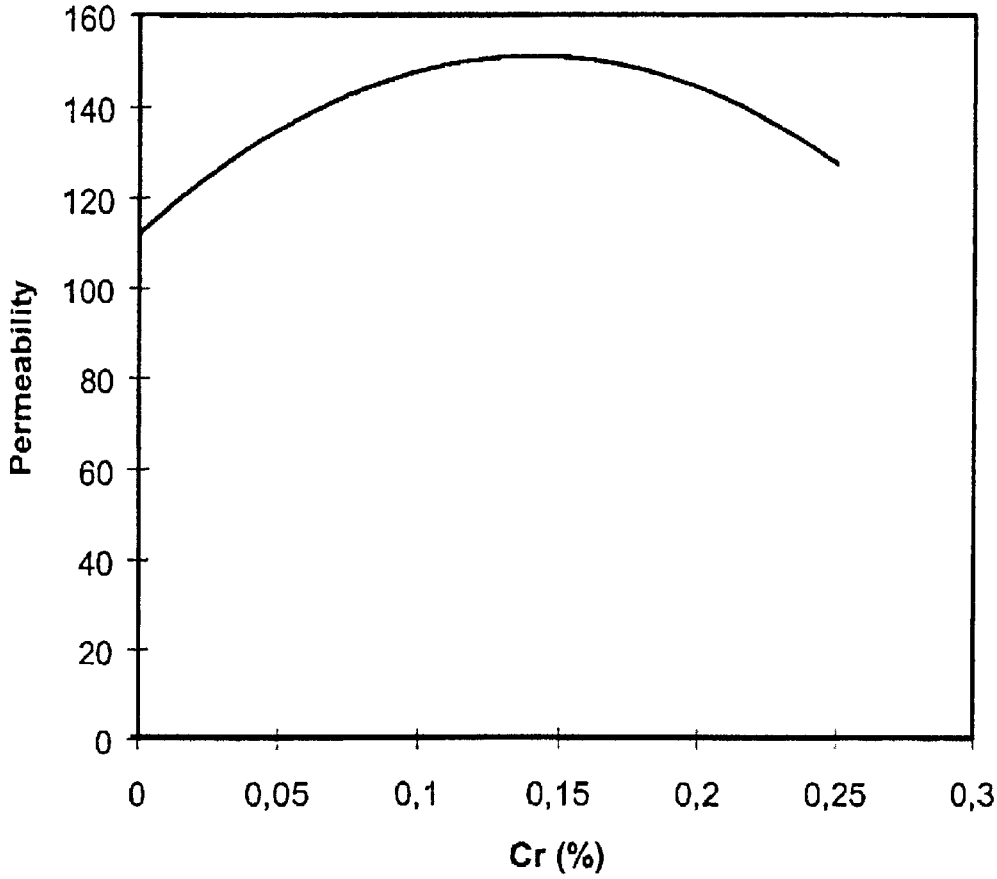
FIG. 5 illustrates the relationship between permeability and chromium content for toroids prepared in Example 2 according to the invention.

In a first step particles of an iron based powder are treated with a chromium containing solution to form a chromium layer at the surface of the iron particles. The powder is preferably a substantially pure water atomised iron powder or a sponge iron powder having irregularly shaped particles. In this context the term "substantially pure" means that the powder should be substantially free from inclusions and that the amounts of the impurities O, C an N should be kept at a minimum. The average particle sizes are generally below 300 $\mu$m and above 10 $\mu$m. Examples of such powders are ABC 100.30, ASC 100.29, AT 40.29, ASC 200, ASC 300, NC 100.24, SC 100.26, MH 300, MH 40.28, MH 40.24 available from Höganäs AB, Sweden.

The Solution

According to a preferred embodiment of the invention the iron powder is mixed with a solution having a predetermined chromium content such as to give a chromium content in the final insulated powder of 0.01 to 0.35 preferably 0.05 to 0.25% by weight. This solution can be prepared by using water or an organic solvent, such as acetone, ethanol etc. together with a chromium containing compound such as $CrO_3$ and/or $Na_2CrO_4$. In the solution chromium is preferably present as chromate and/or hydrogen chromate ions and the pH is below 7. The concentration of the solution as well as the period for treating the powder depends on the desired final chromium content of the final powder. The amount of the solution varies between 5–500 ml per kg iron based powder.

According to a preferred embodiment of the invention the pH of the solution may be adjusted by the addition of a small amount of basic substance, such as a hydroxide of an alkali metal. Examples of such substances are NaOH and KOH. It has thus been found that very stable coatings will be obtained when the concentration of NaOH in the coating solution varies between 0.01 and 0.03% by weight of NaOH calculated on the iron base powder.

The treatment is preferably performed at room temperature and for a period of about a few, e.g. 5 minutes to about 2 hours. The mixture is then heated in order to obtain a dry powder.

The Insulated Powder

Normally the Cr content of the final, dried powder to be compacted should vary between 0.01 and 0.35%, most preferably between 0.05 and 0.25% by weight calculated on the total weight of the insulated powder.

The Compacting Step

Before the compacting step, the Cr-coated iron powder is mixed with a suitable lubricant. Alternatively, the die is lubricated. One type of lubricant which is useful according to the present invention is Kenolube® available from Hoganas AB, Sweden, which can be used in an amount of 0.05–1% by weight of the powder. Other types of lubricants may also be used.

The dried Cr-coated powder might be mixed with a thermosetting or thermoplastic resin before the compaction. This is particularly the case if it is required that the final component should have relatively high strength.

The compacting step is preferably performed in conventional equipment at pressures between about 300 and 1500 MPa. The compaction may be performed at ambient temperature or as warm compaction at elevated temperature.

An important feature of the present invention is that the powder has high compressibility and may be compacted to high densities. Thus it has been found that, when compacted at the same pressure, the density of the compacted insulated powder may be less than 0.1 g/cm$^3$ lower than the density of the base powder (cf FIG. 1) when the bodies are prepared from insulated powders including less than about 0.3% by weight of Cr.

Preferred densities of the compressed bodies according to the present invention are above 7.2 g/cm$^3$ and most preferably above 7.25 g/cm$^3$ which densities are obtained at compaction pressures of about 800 MPa.

The Heat Treatment Step

In the final heat-treatment step the compacted component is heat treated in order to obtain stress relief and recrystallisation of the base material.

As important changes of the properties of the base powder material occur when the material recrystallises and the soft magnetic properties are improved it is important that the insulated powder withstands degradation at and above the recrystallisation temperature, which for the base powders used according to the present invention normally is above 600° C. Preferably the temperature is above 620° C. and most preferably between 650 and 900° C. The heat treatment is preferably carried out in one step. The heat treating period may vary between a few minutes up to 2 h.

The Compacted Heat Treated Body

The compressed bodies prepared according to the present invention are distinguished by good soft magnetic properties such as total loss about 40 W/kg at 1.5 T, 150 Hz, an initial permeability above 450, a coercive force about 200 A/m. The most interesting application for the compressed parts is as core components in AC applications at low or moderate frequencies which in this context means within the frequency range from 50 Hz to 5 kHz.

The properties of the compacted and heat treated bodies prepared according to the present invention were compared with the properties of compacted bodies prepared according to the U.S. Pat. No. 4,602,957. The results are included in FIGS. 1–5, wherein the "Ref" designates samples prepared according to the U.S. Pat. No. 4,602,957.

EXAMPLE 1

This example illustrates the magnetic properties as a function of the heat treating temperature. One kg of iron powder (ABC.100.30 available from Höganäs AB, Sweden) was mixed with an aqueous solution of $CrO_3$ in order to achieve 0.1% of Cr in the final powder. The powder was dried at about 100° C. in a heating oven until it was completely dry. A mixture of the dried insulated iron powder and 0.5% of Kenolube® lubricant was compacted at a pressure of 800 MPa to toroids with outer diameter 5.5 cm, inner diameter 4.5 cm and height 0.5 cm. The toroids were then heat treated for 10 to 30 minutes in air at temperatures between 500 and 800° C. The magnetic properties were measured. FIG. 2 discloses the results from measurements of the coercivity measurements and FIG. 3 discloses the results from measurements of the total loss at 1 T.

A comparison of the results obtained according to the present invention with a coating prepared from the same base powder according to the U.S. Pat. No. 4,602,957 discloses that the known coating does not resist temperatures above about 600° C. without degrading.

EXAMPLE 2

This example illustrates the total loss and permeability as a function of the concentration range.

Insulated powders having a chromium content up to about 0.3% by weight of Cr calculated on the dry base. powder were prepared as above and toroids for magnetic measurements were compacted with a mixture of the iron powders and 0.5% by weight of lubricant as in example 1. The toroids were heat treated in air 650° C. for ten minutes.

FIG. 4 demonstrates the results for loss measurements as a function of the chromium content of the powder and FIG. 5 demonstrates the permeability.

EXAMPLE 3

This example illustrates the effect of NaOH in the solution.

NaOH was dissolved in an aqueous solution of $CrO_3$ and mixed with a high purity iron base powder (ABC.100.30). The amount of NaOH was 0.02% of 1000 g of the iron powder. After drying and compacting at 800 MPa the obtained green bodies were heat treated at 650° C. for 10 minutes. A reference powder was prepared in the same way but no NaOH was added.

As can be seen from the results summarised in the following table the frequency stability (=D$\mu$=change in $\mu$ in the interval 1–10 kHz) is considerably increased by the addition of NaOH.

| | Heat treatment ° C. | $\mu$i 1 kHz | D$\mu$ (1–10 kHz) % | Loss 1.5T, 150 Hz (W/kg) | $\mu$max |
|---|---|---|---|---|---|
| ABC100.30 + $CrO_3$ (aq) | 650 | 148 | 31 | 48 | 500 |
| ABC100.30 + $CrO_3$ + NaOH (aq) | 650 | 144 | 5 | 41 | 500 |

What is claimed is:

1. Process for the preparation of a compressed soft magnetic powder core comprising the steps of compacting an iron based powder the particles of which are insulated by a chromium containing layer heating the compacted body to a temperature sufficient for achieving stress relief and recrystallisation of the iron based material.

2. The process according to claim 1 wherein the iron based powder is a water-atomised powder or a sponge iron powder.

3. The process according to claim 1, wherein the iron based particles have an average particle size of about 10 $\mu$m.

4. The process according to claim 1, wherein particles of the iron based powder are treated with a solution prepared by dissolving $CrO_3$ in water in order to obtain an insulating layer on the iron based powder particles.

5. The process according to claim 4, wherein NaOH is added to the solution.

6. The process according to claim 4, wherein the treatment is performed with a solution and for a period of time sufficient to obtain a chromium content of the insulated powder between about 0.01 and 0.35% by weight, calculated on the total weight of the insulated powder.

7. The process according to claim 1, wherein the insulated powder is mixed with 0.01–1% by weight of lubricant before compacting.

8. The process according to claim 1, wherein the compaction is performed at a pressure between 300 and 1500 Mpa.

9. The process according to claim 8, wherein the compacting step is performed at ambient or elevated temperature.

10. The process according to claim 1, wherein the compacted body is heated to a temperature above about 620° C.

11. The process according to claim 1, wherein the compacted body is heated to a temperature between about 620° C. and 900° C.

12. The process according to claim 10, wherein the heating step is performed for a period of between a few minutes and 2 hours.

13. A magnetic powder core as prepared according to claim 1, for use at low and moderate frequencies.

14. The process according to claim 2, wherein the iron based particles have an average particle size of about 10 $\mu$m.

15. The process according to claim 2, wherein particles of the iron based powder are treated with a solution prepared by dissolving $CrO_3$ in water in order to obtain an insulating layer on the iron based powder particles.

16. The process according to claim 3, wherein particles of the iron based powder are treated with a solution prepared by dissolving $CrO_3$ in water in order to obtain an insulating layer on the iron based powder particles.

17. The process according to claim 5, wherein the treatment is performed with a solution and for a period of time sufficient to obtain a chromium content of the insulated powder between about 0.01 and 0.35% by weight, calculated on the total weight of the insulated powder.

18. The process according to claim 4, wherein the treatment is performed with a solution and for a period of time sufficient to obtain a chromium content of the insulated powder between about 0.05 and 0.25% by weight, calculated on the total weight of the insulated powder.

19. The process according to claim 5, wherein the treatment is performed with a solution and for a period of time sufficient to obtain a chromium content of the insulated powder between about 0.05 and 0.25% by weight, calculated on the total weight of the insulated powder.

20. The process according to claim 11, wherein the heating step is performed for a period of between a few minutes and 2 hours.

* * * * *